US006664719B2

(12) United States Patent
Matsutani et al.

(10) Patent No.: US 6,664,719 B2
(45) Date of Patent: Dec. 16, 2003

(54) SPARK PLUG

(75) Inventors: Wataru Matsutani, Aichi (JP); Masayuki Segawa, Aichi (JP); Satoko Ito, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/106,249

(22) Filed: Mar. 27, 2002

(65) Prior Publication Data

US 2003/0038576 A1 Feb. 27, 2003

(30) Foreign Application Priority Data

Mar. 28, 2001 (JP) ..... 2001-091585

(51) Int. Cl.[7] ..... H01T 13/20
(52) U.S. Cl. ..... 313/141; 313/142
(58) Field of Search ..... 313/141, 118, 313/142, 144

(56) References Cited

U.S. PATENT DOCUMENTS 4,700,103 A 10/1987 Yamaguchi et al. ..... 313/141
5,977,695 A * 11/1999 Osamura et al. ..... 313/141
6,078,129 A * 6/2000 Gotou et al. ..... 313/141
6,121,719 A 9/2000 Matsutani et al. ..... 313/141
6,147,441 A 11/2000 Osamura ..... 313/141
6,166,479 A * 12/2000 Matsutani et al. ..... 313/141
6,262,522 B1 7/2001 Osamura et al. ..... 313/141
6,304,022 B1 * 10/2001 Matsutani ..... 313/141
6,326,720 B1 * 12/2001 Ito et al. ..... 313/141

OTHER PUBLICATIONS

European Search Report for EP 02 25 2238 dated Feb. 14, 2003.

* cited by examiner

*Primary Examiner*—Don Wong
*Assistant Examiner*—Thuy Vinh Tran
(74) *Attorney, Agent, or Firm*—Sughrue Mion, PLLC

(57) ABSTRACT

A spark plug having a discharge portion formed of a noble-metal chip, the spark plug being capable of restraining wear observed on a slenderized discharge portion in particular. Discharge portion (31) includes noble-metal chip (31'). Dimension D is 0.3–0.8 mm; and H is 0.4–2 mm, where D (mm) is a diameter representing the outside diameter of the noble-metal chip, and H (mm) is a discharge portion thickness representing the shortest distance between the periphery of a discharge face **(31*t*) and a corresponding end edge of a weld zone W where a center electrode (3) and the noble-metal chip (31') are welded. Further, the noble-metal chip (31')** contains a predominant amount of Ir and 0.5–8% by weight Ni.

17 Claims, 6 Drawing Sheets

SPARK PLUG

BACKGROUND OF THE INVENTION

1. Field of the Invention

The present invention relates to a spark plug for use in an internal combustion engine.

2. Description of the Related Art

A spark plug used for ignition in an internal combustion engine, such as an automobile engine, is affected by a tendency of increasing combustion chamber temperature for the purpose of increasing engine output and improving fuel economy. In order to enhance ignition, in an increasing number of engines the discharge portion of a spark plug projects into a combustion chamber. In such applications, a discharge portion of the spark plug is exposed to high temperature, and thus spark-effected wear of the discharge portion tends to accelerate. In order to enhance spark-effected wear resistance of a discharge portion, many spark plugs have been proposed of the type in which a noble-metal chip containing a predominant amount of Pt, Ir, or a like element is welded to the tip of an electrode.

For example, Japanese Patent Application Laid-Open (kokai) No. 9-7733 discloses a spark plug in which a noble-metal chip contains a predominant amount of Ir and Rh so as to utilize the merit of Ir; i.e., high melting point, and simultaneously prevent oxidation volatilization of Ir at high temperature (about 900° C. or higher), to thereby enhance wear resistance at higher temperatures.

According to recent tendencies, in addition to enhancement of wear resistance, enhancement of ignitability has also been required. In order to meet this demand, the diameter (chip diameter) of a discharge portion (noble-metal chip) is reduced, or the length of a discharge portion projecting from a center electrode is increased, whereby the discharge portion is slenderized to thereby reduce discharge voltage.

3. Problems to be Solved by the Invention

However, experiments conducted by the present inventors have revealed that, even when a noble-metal chip having excellent wear resistance as described in Japanese Patent Application Laid-Open (kokai) No. 9-7733 is used, the thus-slenderized discharge portion is still subject to wear. The present inventors conducted the following experiment. A 6-cylinder gasoline engine (having a piston displacement of 2000 cc) was equipped with a spark plug configured such that only the center electrode had a discharge portion implemented by a noble-metal chip containing a predominant amount of Ir and 20% by weight Rh. The gasoline engine was operated at a speed of 5000 rpm with the throttle opened completely and using unleaded gasoline as fuel. After twenty-hours of operation, the appearance of the discharge portion was observed. As shown in FIG. 6, the discharge portion exhibited unusual wear; specifically, the discharge portion is arcuately eroded at a circumferential side surface, which is not a discharge face. In FIG. 6, the discharge face is the top surface of the discharge portion. As understood from FIG. 6, such wear is unusual in terms of its form, and the cause for the wear cannot be explained by merely spark discharge and oxidation volatilization. Therefore, the problem cannot be solved by a conventional method designed to restrain merely spark-effected wear and simple oxidation wear of a discharge portion implemented by a noble-metal chip.

SUMMARY OF THE INVENTION

It is therefore an object of the present invention to provide a spark plug in which a discharge portion is formed of a noble-metal chip, the spark plug being capable of restraining unusual wear as markedly observed on a slenderized discharge portion in particular.

The above object of the present invention has been achieved by providing a spark plug comprising a center electrode and a ground electrode, which is disposed such that a side surface thereof faces an end face of the center electrode, and having a discharge portion having a discharge face formed, by welding of a noble-metal chip, on at least either the center electrode or the ground electrode at a position corresponding to a spark discharge gap, the spark plug being characterized in that:

D is 0.3–0.8 mm; and

H is 0.4–2 mm, where D (mm) is a chip diameter representing an outside diameter of the noble-metal chip; and H (mm) is a discharge portion thickness representing a shortest distance between a periphery of the discharge face and a corresponding end edge of a weld zone where the noble-metal chip and the center electrode and/or the ground electrode are welded, the spark plug being further characterized in that:

the noble-metal chip contains a predominant amount of Ir and 0.5–8% by weight Ni.

The present inventors examined the unusually worn discharge portion shown in FIG. 6 and found that a deposit containing Ca and/or P was formed on the surface of the discharge portion. No unusual wear was observed on some discharge portions to which the deposit adheres. However, all of the discharge portions suffering unusual wear exhibited adhesion of the deposit induced by Ca and/or P. Therefore, such a deposit may be partially responsible for the above-mentioned unusual wear. As is apparent from FIG. 6, the unusual wear proceeds on a discharge portion only from a certain direction, implying that the unusual wear is partially caused by the existence of a certain fluid flow within an ignition atmosphere where the discharge portion ignites. For example, conceivably, the above-mentioned fluid may be a constant mixture flow (swirl flow) for uniformly diffusing fuel contained in the mixture. Also, the unusual wear may proceed from the above-mentioned two causes. In any case, the mechanism of such unusual wear is presumed to differ from that of wear arising as a result of melting or dispersion caused by spark discharge or that of wear arising as a result of simple oxidation volatilization on a discharge portion. Therefore, conventional methods have failed to completely restrain such unusual wear.

Focusing on the phenomenon that, as shown in FIG. 6, in the unusually worn portion the periphery of the discharge face is almost free from unusual wear, the present inventors analyzed the periphery of the discharge face for components and found Ni present in the periphery of the discharge face. The present inventors also analyzed the unusually worn portion (circumferential side surface) and found Ni absent there. That is, the Ni present in the periphery of the discharge face did not originate with fabrication of the noble-metal chip, but rather was introduced during use of the spark plug. Conceivably, repeated spark discharge causes Ni components to fly out from the ground electrode, which is formed of an Ni-based heat resistant alloy or a like metal; and the Ni components are subsequently injected into the periphery of the discharge face of the discharge portion. In any case, the present inventors acquired knowledge that, in an unusually worn discharge portion, a zone (the periphery of a discharge face) that is not susceptible to unusual wear contains Ni.

The present inventors found that the unusual wear is likely to occur particularly on a discharge portion slenderized, for enhancement of ignition, such that the outside diameter thereof (noble-metal chip diameter) is reduced, and the length of projection thereof from the center electrode is increased. Specifically, a spark plug having a slenderized discharge portion is a spark plug whose discharge portion assumes the following chip diameter D (mm) and thickness H (mm): D: 0.3–0.8 mm, H: 0.4–2 mm; particularly, D: 0.3–0.6 mm, H: 0.5–2 mm. A chip diameter D in excess of 0.8 mm or a discharge portion thickness H less than 0.4 mm departs from the concept of slenderizing the discharge portion. Such dimensions (D>0.8 mm, H<0.4 mm) are unlikely to result in the aforementioned unusual wear, and are therefore outside the scope of the present invention. A discharge portion thickness H of not less than 0.5 mm is particularly preferred for yielding the effect of slenderization. A chip diameter D less than 0.3 mm fails to maintain sufficient durability against ordinary wear induced by spark discharge, oxidation volatilization, etc. The present invention is not intended to solve such a problem. When the discharge portion thickness H exceeds 2 mm, the discharge portion tends to accumulate heat excessively and thus wears abruptly. Such wear cannot be restrained even through application of the present invention. Therefore, the chip diameter D is specified as not less than 0.3 mm, and the discharge portion thickness H is specified as not greater than 2 mm.

The above-described slenderized discharge portion is markedly susceptible to unusual wear, conceivably for the reason that, as a result of slenderization, the discharge portion becomes likely to assume a high temperature. Presumably, an increase in temperature of the discharge portion activates the aforementioned presumed causes (deposit and a flow of mixture caused by fuel) for unusual wear. Therefore, the present invention is favorably applicable not only to a spark plug whose discharge portion is slenderized, but also to a spark plug configured such that an increase in temperature of the discharge portion is unavoidable due to poor heat release from the discharge portion. The present inventors carried out extensive studies as described above and as a result found that, when a slenderized discharge portion; specifically, a discharge portion having a chip diameter D (mm) of 0.3–0.8 mm and a discharge portion thickness H (mm) of 0.4–2 mm, is formed of a noble-metal chip which contains a predominant amount of Ir (i.e., containing more than 50 weight percent of Ir) and 0.5–8% by weight Ni, the aforementioned unusual wear can be restrained, thereby completing the present invention. In this invention, 'Ir base alloy' means an alloy including more than 50 weight percent of Ir.

The Ni content of the noble-metal chip is 0.5–8% by weight. An Ni content less than 0.5% by weight fails to sufficiently exhibit the effect of restraining unusual wear. An Ni content in excess of 8% by weight is too high, resulting in impaired durability against ordinary wear caused by spark discharge. Accordingly, the noble-metal chip preferably contains 0.5–8% by weight Ni, more preferably 1–4% by weight Ni, for effectively preventing both unusual wear and wear caused by spark discharge and oxidation volatilization. The noble-metal chip is formed of an Ir base alloy, which contains a predominant amount of Ir. Because of good durability against spark discharge, an Ir base alloy can be favorably applied to the noble-metal chip.

The noble-metal chip may contain one or more elements selected from the group consisting of Pt, Pd, Rh, Ru and Re. In addition to restraint of unusual wear which is effected by the Ni component contained in an amount falling within the above-described range, the noble-metal chip formed of the above-mentioned Ir base alloy and containing such an element(s) can restrain oxidation volatilization of Ir at high temperature. Particularly preferably, Rh is contained in an amount of 0.5–40% by weight. An Rh content of less than 1% by weight is insufficient for yielding the effect of restraining oxidation volatilization, whereas an Rh content in excess of 40% by weight causes a drop in melting point of the noble-metal chip, with a resultant failure to effectively restrain wear caused by spark discharge. Accordingly, Rh contained in an amount falling within the above-described range can effectively restrain wear of the discharge portion other than the aforementioned unusual wear; i.e., wear caused by spark discharge, wear caused by oxidation volatilization of Ir, etc.

The noble-metal chip may contain at least either Ru or Re in an amount of 1–5% by weight. These elements are inferior to Ir but effective for enhancing durability against spark discharge, since they are higher in melting point than Rh. Since these elements are less likely than Ir to undergo oxidation volatilization at high temperature, addition of these elements is effective for enhancing high-temperature oxidation resistance. When their content is less than 1% by weight, the above-mentioned effects cannot be sufficiently obtained. When their content exceeds 5% by weight, spark-effected wear resistance and high-temperature oxidation resistance are impaired. Therefore, their preferred content falls within the above-mentioned range.

The noble-metal chip may contain an oxide (composite oxide) of an element(s) selected from the group consisting of Sr, Y, La, Ce, Pr, Nd, Sm, Eu, Gd, Tb, Dy, Ho, Er, Tm, Yb, Lu, Ti, Zr and Hf, to thereby more effectively restrain oxidation volatilization of Ir at high temperature. Preferably, the oxide(s) is contained in an amount of 0.5–3% by weight. An oxide content of less than 0.5% by weight fails to sufficiently yield the expected effect of preventing oxidation volatilization of an added metal element component(s). An oxide content in excess of 3% by weight may only impair heat resistance of the noble-metal chip. Preferably, at least either $La_2O_3$ or $Y_2O_3$ is contained as the above-mentioned oxide. Additionally, $ThO_2$, $ZrO_2$, or a like oxide can be favorably employed.

In order to achieve the above-described object, the present invention provides a spark plug comprising a center electrode and a ground electrode, which is disposed such that a side surface thereof faces an end face of the center electrode, and having a discharge portion having a discharge face formed, by welding of a noble-metal chip, on at least either the center electrode or the ground electrode at a position corresponding to a spark discharge gap, said spark plug being characterized in that: the noble-metal chip comprises an Ir base alloy containing 0.5–40% by weight of Rh and 1–4% by weight of Ni.

By using an Ir base alloy comprising 1 to 4 wt % of Ni and 0.5 to 40 wt % of Rh for the noble-metal chip, unusual wear such as scooping-out at the peripheral surface of the spark discharge portion can be effectively prevented. Further, wear of spark discharge portion caused by spark discharge and by oxidation volatilization of Ir other than by said unusual wear can be effectively prevented. As the result, a long-life spark plug can be provided. Additionally, 1 to 5 wt % of at least one of Ru and Re can be added to advantageously improve wear caused by spark discharge.

Description of Reference Numerals

Figure 1:
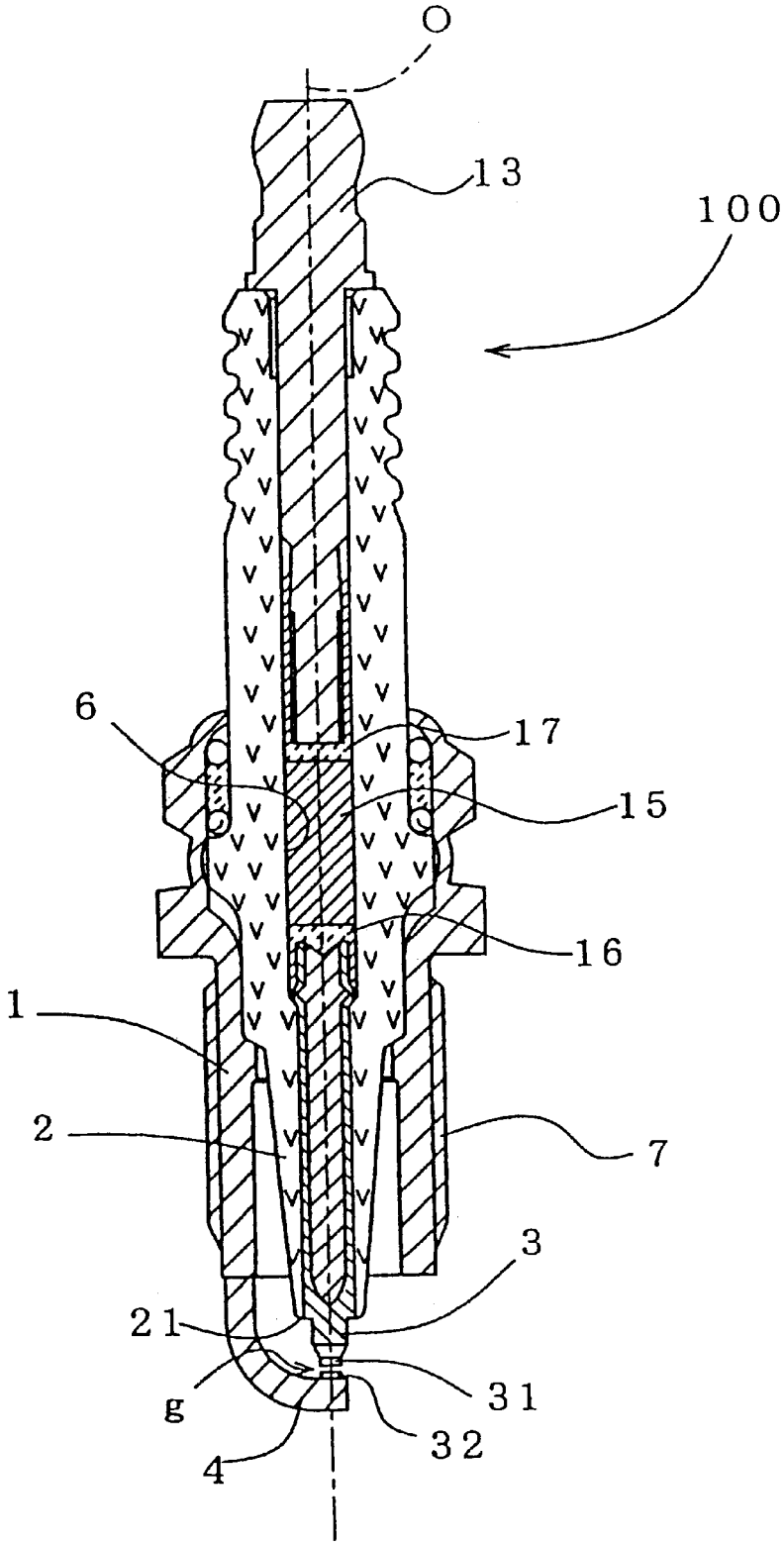
FIG. 1 is a front general sectional view showing an embodiment of a spark plug of the present invention.

100: spark plug
3: center electrode
2: insulator
1: metallic shell
4: ground electrode
g: spark discharge gap
31, 32: discharge portion
31*t*: discharge face
W: weld zone
31', 32': noble-metal chip

DESCRIPTION OF THE PREFERRED EMBODIMENTS

Figure 2:
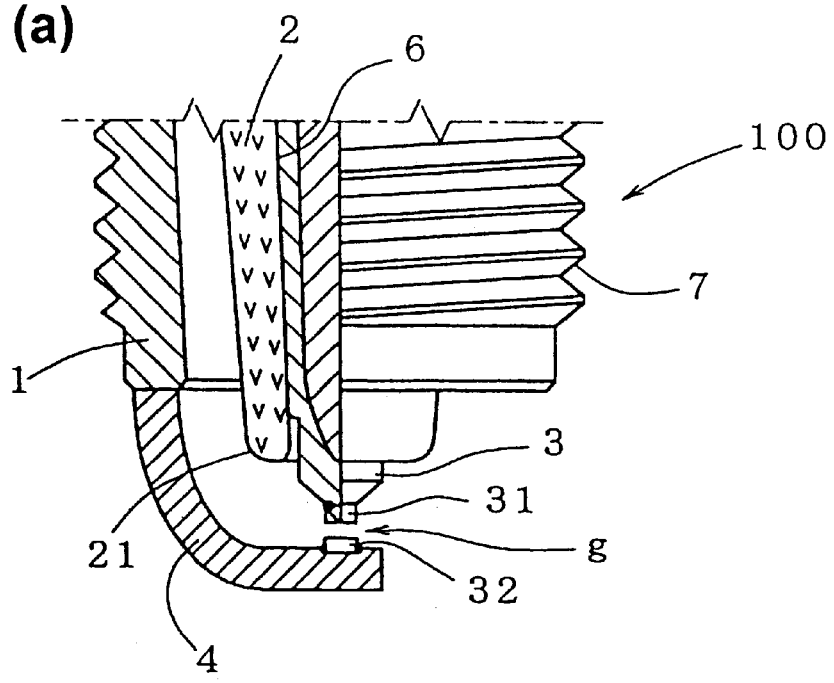
FIG. 2(*a*) is a partial sectional view of the spark plug of FIG. 1, and FIG. 2(*b*) is an enlarged sectional view showing a main portion of the spark plug.
Figure 2:
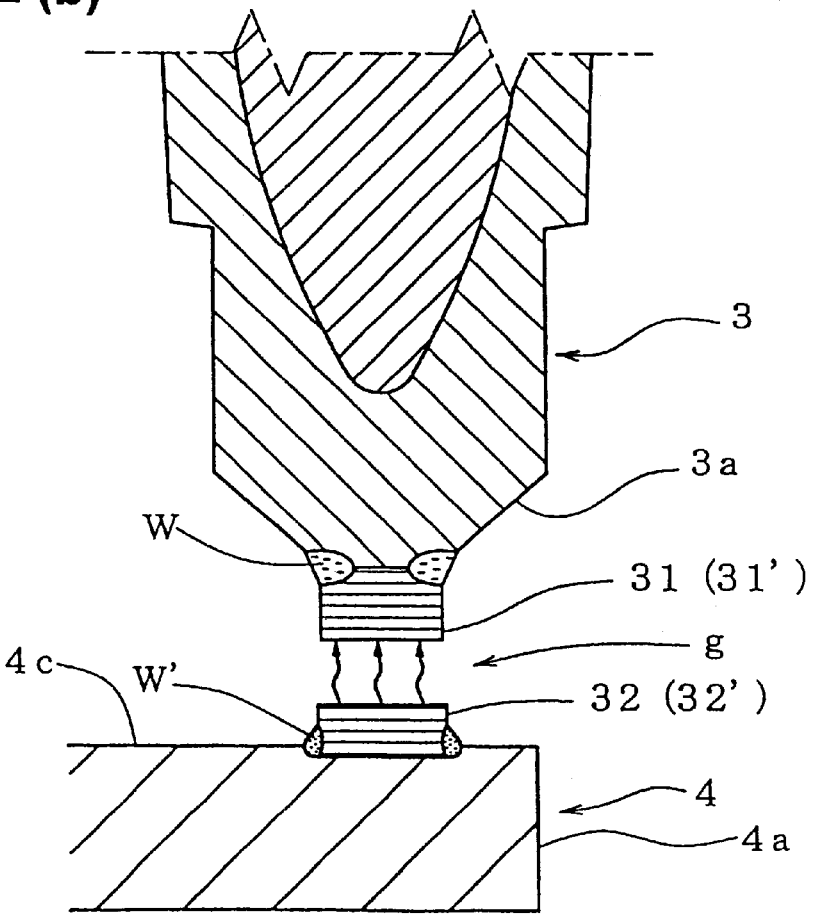

Embodiments of the present invention will next be described with reference to the drawings. However, the present invention should not be construed as being limited thereto. FIG. 1 is a vertical sectional view showing an example of a spark plug 100 of the present invention. FIG. 2(*a*) is an enlarged view showing a discharge portion and its periphery of the spark plug 100. The spark plug 100, having a vertical axis O and which is an example of the present invention and contains a resistor, includes a cylindrical, metallic shell 1; an insulator 2, which is fitted into the metallic shell 1 such that a tip portion 21 projects from the metallic shell 1; a center electrode 3, which is disposed within the insulator 2 such that a discharge portion 31 formed on the tip thereof projects from the insulator 2; and a ground electrode 4, whose one end is joined to the metallic shell 1 by welding or a like process and whose opposite end portion 4*a* is bent such that its side surface 4*c* faces the discharge portion 31 formed on the center electrode 3. A discharge portion 32 corresponding to the discharge portion 31 is formed on the ground electrode 4. A gap formed between the discharge portion 31 and the discharge portion 32 serves as a spark discharge gap g.

The insulator 2 is formed of, for example, an alumina or aluminum nitride ceramic sintered body and has a through-hole 6 formed therein along the axial direction thereof for receiving the center electrode 3. The metallic shell 1 is formed of a metal, such as low-carbon steel, into a cylindrical shape to thereby form a housing of the spark plug 100. A threaded portion 7 is formed on the outer circumferential surface of the metallic shell 1 for mounting the spark plug 100 onto an unillustrated engine block. A metallic terminal member 13 is fixedly inserted into the through-hole 6 from its one end, and the center electrode 3 is fixedly inserted into the through-hole 6 from its opposite end. A resistor 15 is disposed within the through-hole 6 between the metallic terminal member 13 and the center electrode 3. The resistor 15 is electrically connected, at opposite end portions thereof, to the center electrode 3 and the metallic terminal member 13 via electrically conductive glass seal layers 16 and 17, respectively. Notably, either one of the facing discharge portions 31 and 32 may be omitted. In this case, the spark discharge gap g is formed between the discharge portion 31 and the ground electrode 4 or between the discharge portion 32 and the center electrode 3.

The discharge portion 31 is formed, for example, in the following manner. As shown in FIG. 2(*b*), a disk like noble-metal chip 31' is brought in contact with a tip portion 3*a* of the center electrode 3, which is formed of, for example, an Ni base heat resistant alloy, such as INCONEL 600 (available from INCO Corp., UK), or an Fe base heat resistant alloy. Then, a weld zone W is formed along the circumferential edge of interface between the components by laser welding, electron beam welding, resistance welding, or a like process, thereby joining the components. In the case where the discharge portion 32 is to be formed on the ground electrode 4, which is formed of, for example, an Ni base heat resistant alloy, such as INCONEL 600 (available from INCO Corp., UK), the discharge portion 32 is formed in the following manner. A noble-metal chip 32' is positioned on the ground electrode 4 at a position corresponding to the discharge portion 31 associated with the center electrode 3. Then, similarly, a weld zone W' is formed along the outer circumferential edge of interface between the components, thereby joining the components.

The discharge portion 31 or 32 is formed by use of the noble-metal chip 31' or 32' formed of an Ir base alloy, which contains a predominant amount of Ir and 0.5–8% by weight Ni. The noble-metal chip 31' or 32' contains, as an additive element component(s), one or more elements selected from the group consisting of Pt, Pd, Rh, Ru and Re; for example, Rh in an amount of 1–40% by weight and/or at least either Ru or Re in an amount of 1–5% by weight.

The noble-metal chip 31' or 32' is formed, for example, in the following manner. Material noble-metal powders are mixed according to predetermined proportions. The resultant mixture is melted to form an alloy ingot. Specific examples of melting processes include arc melting, plasma beam melting, and high-frequency induction melting. The ingot may be formed as follows: the molten alloy is cast and then cooled rapidly by use of a water-cooled mold or a like device. The thus-obtained ingot features reduced segregation. Alternatively, the ingot may be formed as follows: a noble-metal powder mixture having a predetermined composition is compacted, followed by sintering.

Subsequently, the alloy ingot is formed into a wire-like or rod-like material by carrying out singly or in combination hot forging, hot rolling, and hot wire drawing. The wire-like or rod-like material is cut along the length direction into pieces, each having a predetermined length. For example, the alloy ingot is formed into a rod-like material by hot forging. The rod-like material undergoes hot rolling, which employs a grooved reduction roll, and hot swaging to thereby further reduce its diameter. Finally, the thus-diameter-reduced material undergoes hot wire drawing to thereby obtain a wire having a diameter not greater than 0.8 mm. Subsequently, the wire is cut into pieces each having a predetermined thickness, thereby obtaining noble-metal chips 31' or 32'.

The noble-metal chip 31' or 32' may also be formed in the following manner. Alloy components are mixed and melted to obtain a molten alloy. The molten alloy is hot-rolled into a sheet. The sheet is subjected to hot blanking to blank out chips having a predetermined shape. Alternatively, a spherical noble-metal alloy is formed by a known atomization process. The thus-formed spherical noble-metal alloy may be used as a discharge portion as atomized or may be compressed, by use of a press or flat dies, into a flat or columnar noble-metal chip 31' or 32'.

Figure 3:
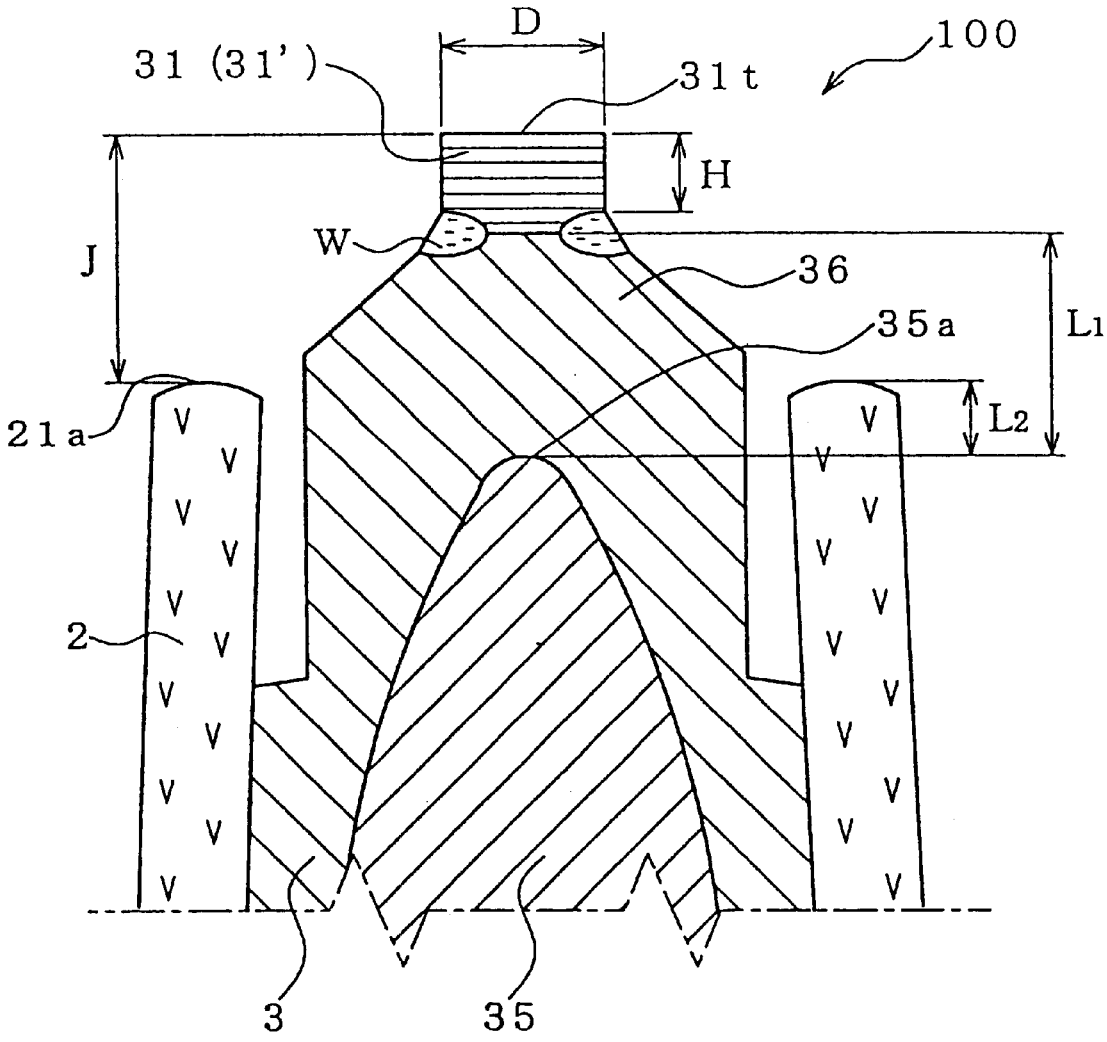
FIG. 3 is a view showing a discharge portion and its periphery in an enlarged condition and illustrating the definition of chip diameter D, discharge portion thickness H, etc.

As shown in FIG. 3, the spark plug of the present invention has a slenderized discharge portion 31. Specifically, a noble-metal chip serving as the discharge portion 31 has a chip diameter D (mm) of 0.3–0.8 mm and a discharge portion thickness H (mm) of 0.4–2 mm. The chip diameter D and the discharge portion thickness H are defined as shown in FIG. 3. That is, the chip diameter D is the outside diameter D of the discharge portion 31, and the discharge portion thickness H is the shortest distance between the periphery of a discharge face 31*t* of the discharge portion 31 and a corresponding end edge of the weld zone W where the center electrode 3 and the noble-metal chip 31' are welded. As in the case of the above-described discharge portion 31 associated with the center electrode 3, the chip diameter D and the discharge portion thickness H can be defined similarly for the discharge portion 32 associated with the ground electrode 4.

The spark plug 100 of the present embodiment is configured such that the discharge portion 31 associated with the center electrode 3 is likely to increase in temperature. For example, as shown in FIG. 3, a core 35 is formed at a center portion of the center electrode 3, the core 35 being superior in thermal conductivity to an electrode base material 36 which forms a surface layer portion. The shortest distance L1 measured along the axial direction between the discharge portion 31 and a tip 35*a* of the core 35 (hereinafter also referred to as a core tip) located on the side toward the spark discharge gap g is 1–3 mm. Notably, the core 35 is adapted to release heat from the discharge portion 31 toward the center electrode 3 and is formed of Cu, a Cu alloy, or a like metal. In the above-described configuration, when the distance L1 is less than 1 mm, the tip 35*a* of the core 35 is unavoidably located on a side toward the discharge portion 31 with respect to a tip 21*a* of the insulator. As a result, the core 35 expands due to excessive accumulation of heat and may break the insulator 2 from the inside. Also, the electrode base material 36, which forms the surface layer portion, may be worn with resultant exposure of the core 35. When L1 exceeds 3 mm, the temperature of the discharge portion 31 becomes too high; as a result, the discharge portion 31 fails to resist wear effected by spark discharge. Preferably, L1 is 1.5–2.5 mm.

Figure 4:
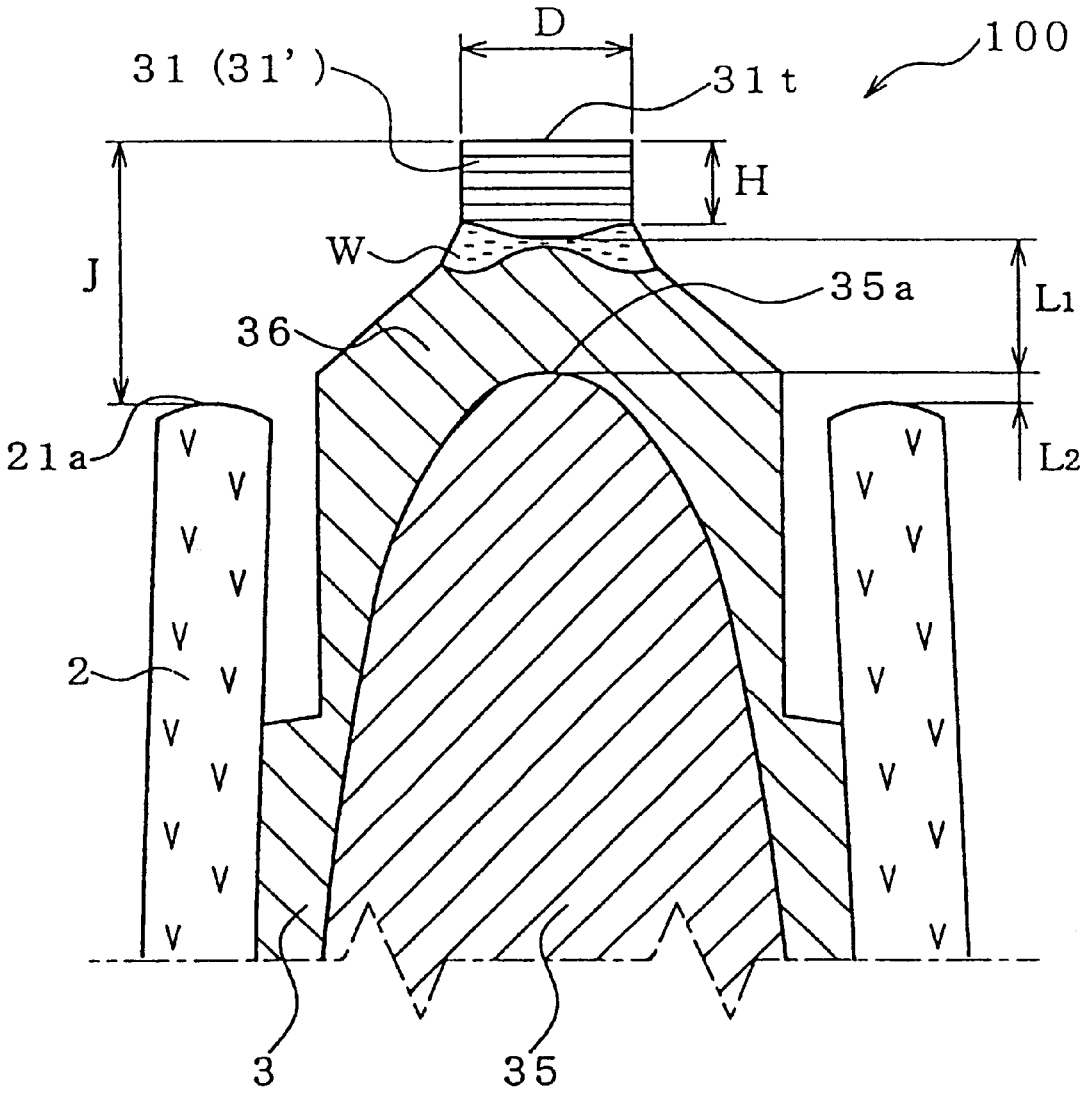
FIG. 4 is a view explaining the definition of chip diameter D, discharge portion thickness H, etc., subsequent to FIG. 3.

As shown in FIG. 4, the weld zone W for welding the noble-metal chip 31' and the center electrode 3 may be formed continuously along the diametral direction of the noble-metal chip 31'. In this case, the shortest distance L1 between the discharge portion 31 and the tip 35*a* of the core 35 is defined similarly as in the case of FIG. 3.

As shown in FIG. 3, when the letter J represents the shortest distance measured along the axial direction between the discharge face 31*t* and the tip 21*a* of the insulator 2 (hereinafter also referred to as an insulator tip) located on the side toward the spark discharge gap g, the distance J is preferably not less than 1.5 mm. Employing a J value of not less than 1.5 mm causes a reduction in discharge voltage but favorably allows application of the present invention since the discharge portion 31 tends to assume a high temperature. When the J value is less than 1.5 mm, the electric field becomes unlikely to be concentrated on the discharge face 31*t*, and thus discharge voltage increases; therefore, the effect of slenderization of the discharge portion 31 is lost.

As shown in FIGS. 3 and 4, when L2 represents the shortest distance measured along the axial direction between the tip 21*a* of the insulator 2 and the tip 35*a* of the core 35, L2 is not greater than 1 mm in the case where the tip 35*a* of the core 35 is located on the side toward the discharge face 31*t* with respect to the tip 21*a* of the insulator 2 (in the case of FIG. 4); and L2 is not greater than 1.5 mm in the case where the tip 21*a* of the insulator 2 is located on the side toward the discharge face 31*t* with respect to the tip 35*a* of the core 35 (in the case of FIG. 3). By specifying the range of the L2 value as described above, the previously defined L1 value can be readily set so as to fall within the preferred range.

The above-described spark plug 100 is mounted on an engine block via the threaded portion 7 thereof and used as an ignition source for igniting a mixture to be fed into a combustion chamber. In the course of use, a discharge voltage is applied between the discharge portions 31 and 32 to thereby generate sparks in the spark discharge gap g (reference numerals correspond to those in FIG. 1). When the spark plug 100 of the present invention is used in an ignition atmosphere in which Ca and P are present, the effect of the present invention is effectively obtained. Since Ca and/or P in the ignition atmosphere are present in engine oil for use with an internal combustion engine, the spark plug 100 of the present invention can be favorably used in an internal combustion engine which uses such engine oil.

EXAMPLES

In order to study the effect of the present invention, the following experiments were conducted.

Experiment Example 1

Noble-metal chips for use as a discharge portion of a spark plug were manufactured in the following manner. Predetermined element components were mixed according to various compositions, to thereby obtain various material powders. Next, the material powders were each compacted into a columnar form having a diameter of 20 mm and a length of 130 mm. The thus-formed green compacts were placed within an arc melting furnace and arc melted, to thereby obtain alloy ingots of various compositions. The alloy ingots were each subjected to hot forging, hot rolling, hot swaging, and hot wire drawing, at about 1500° C., to thereby obtain alloy wires each having a diameter of 0.6 mm. The wires were cut along the longitudinal direction into pieces, to thereby obtain disk like noble-metal chips of various compositions each having a diameter (chip diameter: D) of 0.6 mm and a thickness of 0.8 mm. The noble-metal chips were welded to corresponding center electrode base materials made of INCONEL 600 by laser welding, to thereby fabricate spark plugs as shown in FIG. 1 or 2. In the present experiment example, each noble metal chip is welded so that a discharge portion thickness H representing the shortest distance between a periphery of the discharge face and a corresponding end edge of a weld zone where the noble-metal chip and the center electrode are welded is 0.5 mm after laser welding. Also, the discharge portion associated with a ground electrode was formed of a Pt-20% by weight Ni noble-metal chip having a chip diameter of 0.9 mm and a thickness of 0.6 mm.

TABLE 1

| | Composition (% by weight) | Evaluation of degree of unusual wear | Evaluation of wear caused by spark discharge (gap increase) | Total Evaluation | |
|---|---|---|---|---|---|
| 1 | Ir—2Rh—3Ru—2Ni | ○ | ○ | ○ | Example of Invention |
| 2 | Ir—2Rh—3Pt—2Ni | ○ | ○ | ○ | |
| 3 | Ir—2Rh—3Pd—2Ni | ○ | ○ | ○ | |
| 4 | Ir—0.9Rh—3Re—2Ni | ○ | ○ | ○ | |
| 5 | Ir—0.9Rh—3Ni | ○ | ○ | ○ | |
| 6 | Ir—2Rh—2Ni | ○ | ○ | ○ | |
| 7 | Ir—2Ni | ○ | Δ | ○ | |
| 8 | Ir—2Rh—3Ru—0.5Ni | Δ | ○ | Δ | |
| 9 | Ir—2Rh—3Ru—1Ni | ○ | ○ | ○ | |
| 10 | Ir—2Rh—3Re—1Ni | ○ | ○ | ○ | |
| 11 | Ir—2Rh—3Ru—3Ni | ○ | ○ | ○ | |
| 12 | Ir—2Rh—3Re—3Ni | ○ | ○ | ○ | |
| 13 | Ir—3Rh—1Re—2Ru—3Ni | ○ | ○ | ○ | |
| 14 | Ir—2Rh—3Ru—5Ni | ○ | Δ | Δ | |
| 15 | Ir—2Rh—3Ru—8Ni | ○ | Δ | Δ | |
| 16 | Ir—2Rh—3Ru—0.3Ni | X | — | X | Comparative Example |
| 17 | Ir—2Rh—9Ni | ○ | X | X | |
| 18 | Ir—20Rh | X | — | X | |

The thus-obtained spark plugs were subjected to a durability test under the following conditions. The spark plugs were mounted on a gasoline engine (having 6 cylinders) of a piston displacement of 2000 cc. The gasoline engine was run for up to 300 hours at an engine speed of 5000 rpm with the throttle opened completely. Unleaded gasoline was used as fuel, and the tip temperature of a center electrode was 900° C. In the above durability test, the gap of spark discharge of each spark plug was 1.1 mm.

Figure 5:
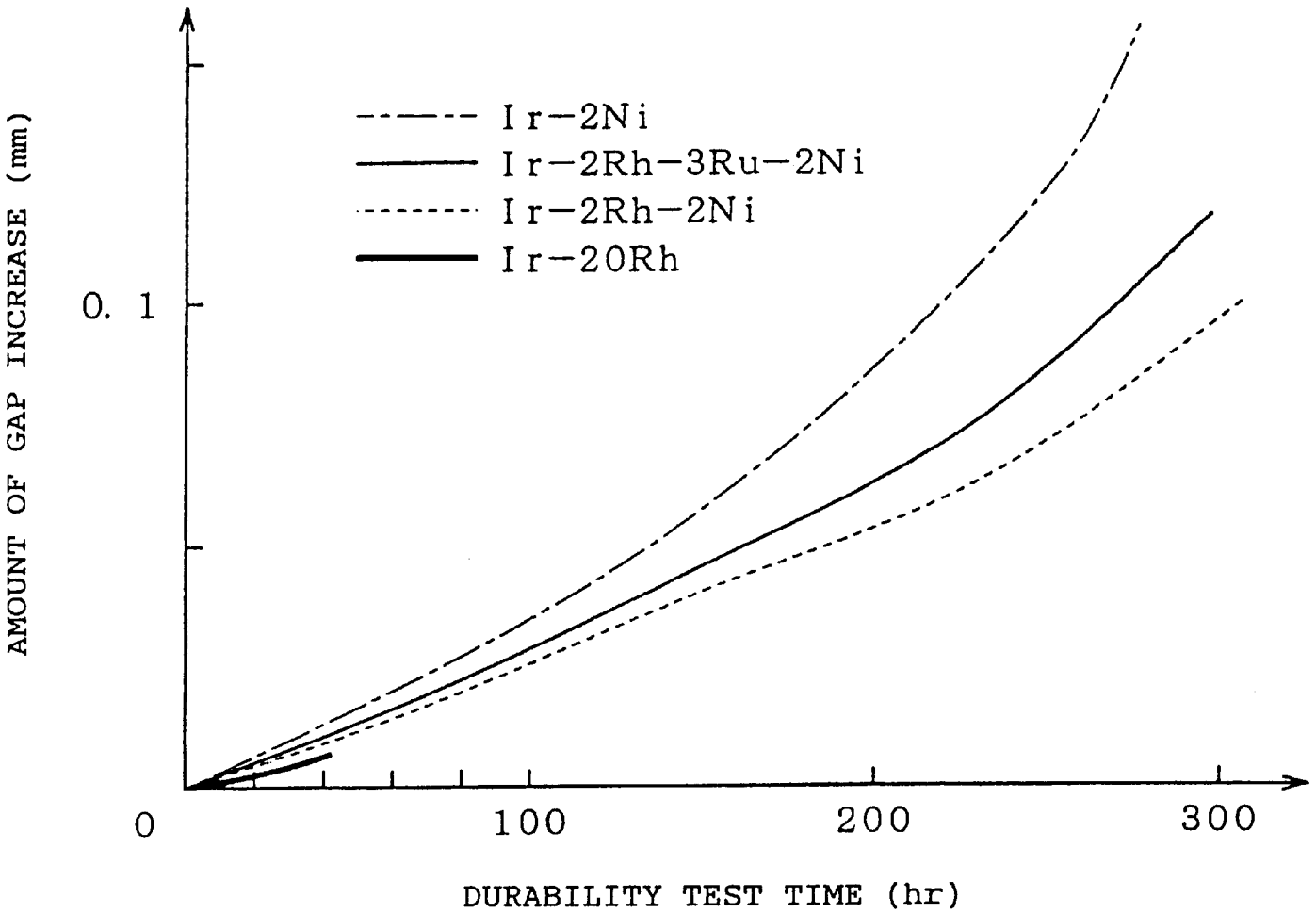
FIG. 5 is a view showing the relationship between durability test time and the amount of gap increase obtained in a durability test conducted relative to various compositions of the noble-metal chip.
Figure 6:
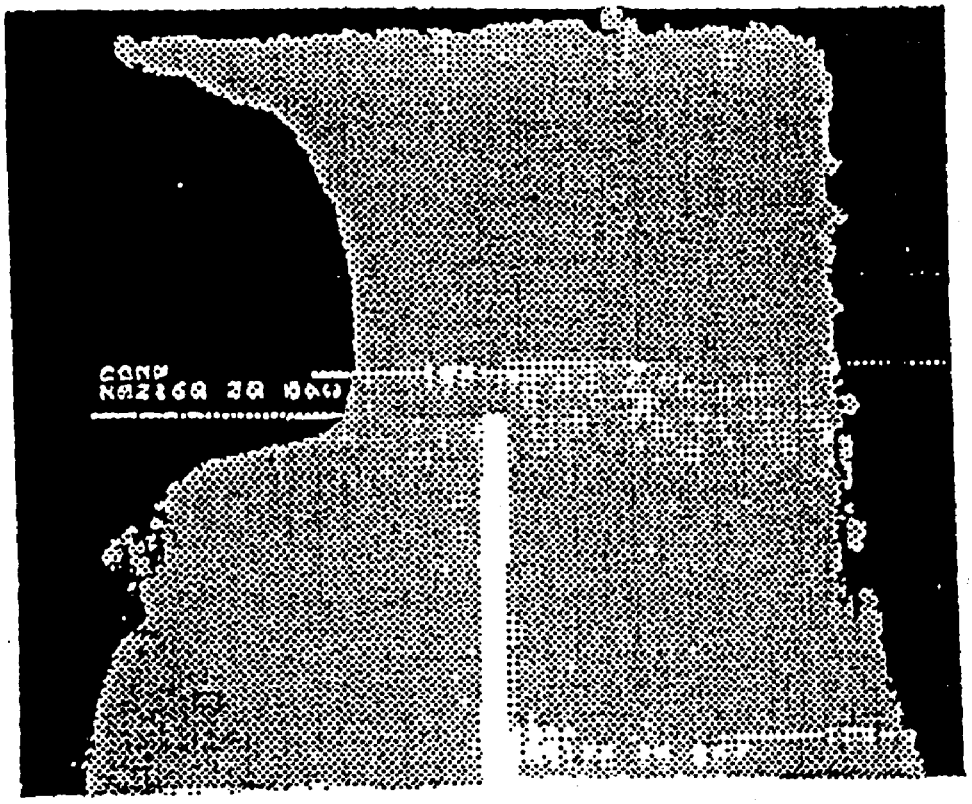
FIG. 6 is an observation view showing a state of unusual wear of a discharge portion.

The relationship between durability test time and the degree of wear of a noble-metal chip was examined by measuring the amount of gap increase after the engine was run for durability test time. FIG. 5 shows the relationship between durability test time and the amount of gap increase with respect to Example Nos. 1, 6, and 7 and Comparative Example No. 18 appearing in Table 1. As shown in FIG. 5, the Examples of the invention, which contained Ni, endured a 300-hour durability test run, whereas the Comparative Example failed to complete the durability test because of unusual wear of a discharge portion, indicating that addition of Ni restrains unusual wear. FIG. 6 is an observation view showing the discharge portion and its periphery of Comparative Example No. 18 as observed through an optical microscope after the durability test. As a result of unusual wear, a side region of the discharge portion was eroded. The Examples of the invention were similarly observed for unusual wear of a discharge portion and its periphery, but unusual wear was hardly observed, indicating that Ni contained therein within a specific range restrained the occurrence of unusual wear.

The spark plugs which had undergone the above-described durability test were visually evaluated for the degree of unusual wear. The evaluation criteria are as follows: unusual wear was not observed: O; unusual wear was observed, but the durability test was completed: Δ; and unusual wear disabled continuation of the durability test: X. The test results of evaluation with respect to unusual wear are shown in Table 1. Further, with regard to spark discharge durability evaluation results of measuring an increase in the amount of gap of each spark plug after the durability test, the evaluation criteria are as follows: increase in the amount of spark discharge gap of less than 0.15 mm: O; 0.15 to 0.3 mm: Δ; more than 0.3 mm: X. The result of considering both the "Evaluation of degree of unusual wear" and "Evaluation of wear caused by spark discharge (gap increase)" is given in Table 1 under "Total Evaluation". As is apparent from Table 1, Ni contained in an amount of 0.5–8% by weight restrains unusual wear and provides durability against spark discharge.

Experiment Example 2

Spark plugs were fabricated in a manner similar to that of Experiment Example 1, except that the composition of the noble-metal chip was that of Example No. 1 or Comparative Example No. 15 in Table 1, and the chip diameter D (mm) and the discharge portion thickness H (mm) of the noble-metal chip were varied as shown in Table 2. The spark plugs were subjected to a durability test conducted under conditions similar to those of Experiment Example 1. Subsequently, the discharge portion and its periphery of each of the spark plugs were observed through an optical microscope for visually evaluating the degree of unusual wear. The evaluation criteria were similar to those of Experiment Example 1. The results are shown in Table 2.

TABLE 2

| | Composition (% by weight) | Chip dia. D (mm) | Discharge portion thickness H (mm) | Evaluation of degree of unusual wear |
|---|---|---|---|---|
| 1 | Ir—20Rh* | 0.2* | 0.6 | — |
| 2 | (outside scope | 0.3 | 0.6 | X |
| 3 | of invention) | 0.8 | 0.6 | X |
| 4 | | 0.9* | 0.6 | ○ |
| 5 | | 0.6 | 0.8 | X |
| 6 | | 0.6 | 0.3* | ○ |
| 7 | | 0.6 | 1.2 | X |
| 8 | | 0.6 | 2.2* | X |
| 9 | | 0.6 | 0.4 | X |
| 10 | Ir—2Rh—3Ru— | 0.2* | 0.6 | — |
| 11 | 2Ni | 0.3 | 0.6 | ○ |
| 12 | | 0.8 | 0.6 | ○ |
| 13 | | 0.9* | 0.6 | ○(no effect) |
| 14 | | 0.6 | 0.8 | ○ |
| 15 | | 0.6 | 0.3* | ○(no effect) |
| 16 | | 0.6 | 1.2 | ○ |
| 17 | | 0.6 | 2.2* | X |
| 18 | | 0.6 | 0.4 | ○ |

Parameters marked with * fall outside the scope of the invention.

Spark plug Nos. 1 and 10 suffered rapid progress of spark-discharge-effected wear because of a chip diameter D less than 0.3 mm and therefore were not counted among spark plugs to be evaluated, regardless of whether an Ni component was present or not. In spark plug Nos. 4, 6, 13 and 15, whose discharge portions were not slenderized; i.e., whose discharge portions had a D value greater than 0.8 mm or an H value less than 0.4 mm, unusual wear as shown in FIG. 6 was not observed, regardless of whether Ni was present or not. In other spark plugs whose discharge portions were slenderized; i.e., whose discharge portions had a D value of 0.3–0.8 mm and an H value of 0.4–2 mm, addition of Ni effectively restrained unusual wear.

Experiment Example 3

Next, spark plugs were fabricated such that the composition of the noble-metal chip serving as a discharge portion was that of Example No. 1 or Comparative Example No. 18 in Table 1, and the lengths L1 and L2 defined previously in the description of the embodiments (FIGS. 3 and 4) were varied as shown in Table 3. The spark plugs had a chip diameter D of 0.3–0.8 mm and a discharge portion thickness H of 0.4–8 mm and other dimensional features similar to those of Experiment Example 1. The spark plugs were subjected to a durability test similar to that conducted in Experiment Examples 1 and 2 and evaluated for the degree of unusual wear as observed on a discharge portion after the durability test. The evaluation criteria were similar to those of Experiment Examples 1 and 2. The results are shown in Table 3. In the present Experiment Example, L2 values whose sign is minus (–) represent the shortest distance between the tip of a core and the tip of an insulator in the case where the tip of the core is located on the side toward a discharge portion with respect to the tip of the insulator as shown in FIG. 4, and other L2 values, as shown in FIG. 3, represent the shortest distance between the tip of a core and the tip of an insulator in the case where the tip of the insulator is located on the side toward a discharge portion with respect to the tip of the core.

TABLE 3

| | Composition (% by weight) | L1 (mm) | L2 (mm) | Evaluation of degree of unusual wear |
|---|---|---|---|---|
| 1 | Ir—20Rh* | 1.0 | 0.3 | X |
| 2 | (outside scope of | 1.0 | –0.2 | X |
| 3 | invention) | 1.5 | 0.8 | X |
| 4 | | 1.5 | 0.3 | X |
| 5 | | 2.0 | 1.3 | X |
| 6 | | 2.0 | 0.8 | X |
| 7 | | 3.0 | 2.3 | X |
| 8 | | 3.0 | 1.8 | X |
| 9 | | 0.8 | 0.1 | Δ |
| 10 | Ir—2Rh—3Ru—2Ni | 1.0 | 0.3 | ○ |
| 11 | | 1.0 | –0.2 | ○ |
| 12 | | 1.5 | 0.8 | ○ |
| 13 | | 1.5 | 0.3 | ○ |
| 14 | | 2.0 | 1.3 | ○ |
| 15 | | 2.0 | 0.8 | ○ |
| 16 | | 3.0 | 2.3 | ○ |
| 17 | | 3.0 | 1.8 | ○ |
| 18 | | 0.8 | 0.1 | ○ |

As shown in Table 3, the Comparative Examples did not contain Ni, and comparative Example Nos. 1–8 having an L1 value of 1 to 3 mm and an L2 value of–1 to 1.5 mm exhibited marked unusual wear of the discharge portion since the discharge portion tends to assume a high temperature. The spark plugs whose L1 and L2 values fell outside the above corresponding ranges (Comparative Example No. 9) exhibited unusual wear; however, the degree of wear was less than those of the spark plugs whose L1 and L2 values fell within the above corresponding ranges, conceivably because the discharge portion is well heat-released and thus becomes unlikely to assume a high temperature. In the case of Example Nos. 10–18, the effect of reducing unusual wear was sufficiently obtained by addition of Ni as observed with the spark plugs whose L1 and L2 values fell outside the above corresponding ranges and even with the spark plugs whose L1 and L2 values fell within the above corresponding ranges and whose discharge portions thus tend to assume a high temperature.

It should further be apparent to those skilled in the art that various changes in form and detail of the invention as shown and described above may be made. It is intended that such changes be included within the spirit and scope of the claims appended hereto.

This application is based on Japanese Patent Application No. 2001-91585 filed Mar. 28, 2001, the disclosure of which is incorporated herein by reference in its entirety.

What is claimed is:

1. A spark plug comprising a center electrode and a ground electrode, which is disposed such that a side surface thereof faces an end face of the center electrode, and having a discharge portion having a discharge face formed, by welding of a noble-metal chip, on the center electrode at a position corresponding to a spark discharge gap, said noble-metal chip projecting from the center electrode between a periphery of the discharge face and a weld portion, said spark plug being characterized in that:

D is 0.3–0.8 mm; and

H is 0.4–2 mm, where D (mm) is a chip diameter representing an outside diameter of the noble-metal chip; and H (mm) is a discharge portion thickness representing a shortest distance between a periphery of the discharge face and a corresponding end edge of a weld zone where the noble-metal chip and the center electrode are welded, said spark plug being further characterized in that:

the noble-metal chip contains a predominant amount of Ir and 0.5–8% by weight Ni.

2. The spark plug as claimed in claim 1, wherein the noble-metal chip contains Ni in an amount of 1–4% by weight.

3. The spark plug as claimed in claim 1, wherein the noble-metal chip contains one or more elements selected from the group consisting of Pt, Pd, Rh, Ru and Re.

4. The spark plug as claimed in claim 1, wherein the noble-metal chip contains Rh in an amount of 0.5–40% by weight.

5. The spark plug as claimed in claim 1, wherein the noble-metal chip contains at least either Ru or Re in an amount of 1–5% by weight.

6. The spark plug as claimed in claim 1, wherein the noble-metal chip contains an oxide or composite oxide of one or more elements selected from the group consisting of Sr, Y, La, Ce, Pr, Nd, Sm, Eu, Gd, Tb, Dy, Ho, Er, Tm, Yb, Lu, Ti, Zr and Hf.

7. The spark plug as claimed in claim 1, wherein the noble-metal chip contains at least either $La_2O_3$ or $Y_2O_3$.

8. A spark plug comprising a center electrode and a ground electrode, which is disposed such that a side surface thereof faces an end face of the center electrode, and having a discharge portion having a discharge face formed, by welding of a noble-metal chip, on at least either the center electrode or the ground electrode at a position corresponding to a spark discharge gap, said spark plug being characterized in that:

the noble-metal chip comprises an Ir—Ni alloy containing 0.5–8% by weight of Ni and 1–5% by weight of at least one of Ru and Re.

9. The spark plug as claimed in claim 8, wherein the noble-metal chip contains Rh in an amount of 0.5–40% by weight.

10. The spark plug as claimed in claim 8, wherein the noble metal chip comprises an Ir—Ni alloy containing 1–4% by weight of Ni and 1–5% by weight of at least one of Ru and Re.

11. A spark plug comprising a center electrode and a ground electrode, which is disposed such that a side surface thereof faces an end face of the center electrode, and having a discharge portion having a discharge face formed, by welding of a noble-metal chip, on at least either the center electrode or the ground electrode at a position corresponding to a spark discharge gap, said spark plug being characterized in that:

the noble-metal chip comprises an Ir base alloy containing 0.5–40% by weight of Rh and 1–4% by weight of Ni.

12. A spark plug comprising a center electrode and a ground electrode, which is disposed such that a side surface thereof faces an end face of the center electrode, and having a discharge portion having a discharge face formed, by welding of a noble-metal chip, on the ground electrode at a position corresponding to a spark discharge gap, said spark plug being characterized in that:

D is 0.3–0.8 mm; and

H is 0.4–2 mm, where D (mm) is a chip diameter representing an outside diameter of the noble-metal chip; and H (mm) is a discharge portion thickness representing a shortest distance between a periphery of the discharge face and a corresponding end edge of a weld zone where the noble-metal chip and the center electrode are welded, said spark plug being further characterized in that:

the noble-metal chip contains a predominant amount of Ir and 1–4% by weight Ni.

13. The spark plug as claimed in claim 12, wherein the noble-metal chip contains one or more elements selected from the group consisting of Pt, Pd, Rh, Ru and Re.

14. The spark plug as claimed in claim 12, wherein the noble-metal chip contains Rh in an amount of 0.5–40% by weight.

15. The spark plug as claimed in claim 12, wherein the noble-metal chip contains at least either Ru or Re in an amount of 1–5% by weight.

16. The spark plug as claimed in claim 12, wherein the noble-metal chip contains an oxide or composite oxide of one or more elements selected from the group consisting of Sr, Y, La, Ce, Pr, Nd, Sm, Eu, Gd, Tb, Dy, Ho, Er, Tm, Yb, Lu, Ti, Zr and Hf.

17. The spark plug as claimed in claim 12, wherein the noble-metal chip contains at least either $La_2O_3$ or $Y_2O_3$.

* * * * *